US006479449B1

(12) United States Patent
Mondin

(10) Patent No.: US 6,479,449 B1
(45) Date of Patent: Nov. 12, 2002

(54) CLEANING SYSTEM INCLUDING A LIQUID CLEANING COMPOSITION DISPOSED IN A WATER SOLUBLE CONTAINER

(75) Inventor: Myriam Mondin, Seraing (BE)

(73) Assignee: Colgate-Palmolive Company, New York, NY (US)

( * ) Notice: Subject to any disclaimer, the term of this patent is extended or adjusted under 35 U.S.C. 154(b) by 0 days.

(21) Appl. No.: 10/126,415

(22) Filed: Apr. 19, 2002

(51) Int. Cl.[7] ..... C11D 17/06; C11D 17/00; C11D 11/00

(52) U.S. Cl. ..... 510/296; 510/360; 510/407; 510/421; 510/425; 510/499; 510/505; 510/506; 510/439

(58) Field of Search ..... 510/296, 360, 510/467, 421, 475, 499, 505, 439, 506

(56) References Cited

U.S. PATENT DOCUMENTS

| | | | | | |
|---|---|---|---|---|---|
| 5,385,959 | A | * | 1/1995 | Tsaur et al. | 523/201 |
| 6,133,214 | A | * | 10/2000 | Jung et al. | 510/296 |
| 2001/0053754 | A1 | * | 12/2001 | Hewitt et al. | 510/293 |
| 2002/0013243 | A1 | * | 1/2002 | Hewitt et al. | 510/293 |
| 2002/0055449 | A1 | * | 5/2002 | Porta et al. | 510/295 |

* cited by examiner

*Primary Examiner*—Necholus Ogden
(74) *Attorney, Agent, or Firm*—Richard E. Nanfeldt

(57) ABSTRACT

A water soluble container having disposed therein a liquid cleaning composition containing at least one nonionic surfactant, triethanol amine, glycerine or a glycol, an anionic surfactant, a perfume and a fatty acid.

5 Claims, No Drawings

CLEANING SYSTEM INCLUDING A LIQUID CLEANING COMPOSITION DISPOSED IN A WATER SOLUBLE CONTAINER

FIELD OF THE INVENTION

This invention relates to a water soluble sachet containing a concentrate of a cleaning composition having excellent foam collapse properties and excellent grease cutting properties designed in particular for cleaning hard surfaces and which is effective in removing grease soil and/or bath soil and in leaving unrinsed surfaces with a shiny appearance.

BACKGROUND OF THE INVENTION

In recent years all-purpose liquid detergents have become widely accepted for cleaning hard surfaces, e.g., painted woodwork and panels, tiled walls, wash bowls, bathtubs, linoleum or tile floors, washable wall paper, etc. Such all-purpose liquids comprise clear and opaque aqueous mixtures of water-soluble synthetic organic detergents and water-soluble detergent builder salts. In order to achieve comparable cleaning efficiency with granular or powdered all-purpose cleaning compositions, use of water-soluble inorganic phosphate builder salts was favored in the prior art all-purpose liquids. For example, such early phosphate-containing compositions are described in U.S. Pat. Nos. 2,560,839; 3,234,138; 3,350,319; and British Patent No. 1,223,739.

In view of the environmentalist's efforts to reduce phosphate levels in ground water, improved all-purpose liquids containing reduced concentrations of inorganic phosphate builder salts or non-phosphate builder salts have appeared. A particularly useful self-opacified liquid of the latter type is described in U.S. Pat. No. 4,244,840.

However, these prior art all-purpose liquid detergents containing detergent builder salts or other equivalent tend to leave films, spots or streaks on cleaned unrinsed surfaces, particularly shiny surfaces. Thus, such liquids require thorough rinsing of the cleaned surfaces which is a time-consuming chore for the user.

In order to overcome the foregoing disadvantage of the prior art all-purpose liquid, U.S. Pat. No. 4,017,409 teaches that a mixture of paraffin sulfonate and a reduced concentration of inorganic phosphate builder salt should be employed. However, such compositions are not completely acceptable from an environmental point of view based upon the phosphate content. On the other hand, another alternative to achieving phosphate-free all-purpose liquids has been to use a major proportion of a mixture of anionic and nonionic detergents with minor amounts of glycol ether solvent and organic amine as shown in U.S. Pat. No. 3,935,130. Again, this approach has not been completely satisfactory and the high levels of organic detergents necessary to achieve cleaning cause foaming which, in turn, leads to the need for thorough rinsing which has been found to be undesirable to today's consumers.

Another approach to formulating hard surfaced or all-purpose liquid detergent composition where product homogeneity and clarity are important considerations involves the formation of oil-in-water (o/w) microemulsions which contain one or more surface-active detergent compounds, a water-immiscible solvent (typically a hydrocarbon solvent), water and a "cosurfactant" compound which provides product stability. By definition, an o/w microemulsion is a spontaneously forming colloidal dispersion of "oil" phase particles having a particle size in the range of 25 to 800 Å in a continuous aqueous phase.

In view of the extremely fine particle size of the dispersed oil phase particles, microemulsions are transparent to light and are clear and usually highly stable against phase separation.

Patent disclosures relating to use of grease-removal solvents in o/w microemulsions include, for example, European Patent Applications EP 0137615 and EP 0137616—Herbots et al; European Patent Application EP 0160762 —Johnston et al; and U.S. Pat. No. 4,561,991 —Herbots et al. Each of these patent disclosures also teaches using at least 5% by weight of grease-removal solvent.

It also is known from British Patent Application GB 2144763A to Herbots et al, published Mar. 13, 1985, that magnesium salts enhance grease-removal performance of organic grease-removal solvents, such as the terpenes, in o/w microemulsion liquid detergent compositions. The compositions of this invention described by Herbots et al. require at least 5% of the mixture of grease-removal solvent and magnesium salt and preferably at least 5% of solvent (which may be a mixture of water-immiscible non-polar solvent with a sparingly soluble slightly polar solvent) and at least 0.1% magnesium salt.

However, since the amount of water immiscible and sparingly soluble components which can be present in an o/w microemulsion, with low total active ingredients without impairing the stability of the microemulsion is rather limited (for example, up to 18% by weight of the aqueous phase), the presence of such high quantities of grease-removal solvent tend to reduce the total amount of greasy or oily soils which can be taken up by and into the microemulsion without causing phase separation.

The following representative prior art patents also relate to liquid detergent cleaning compositions in the form of o/w microemulsions: U.S. Pat. No. 4,472,291—Rosario; U.S. Pat. No. 4,540,448 —Gauteer et al; U.S. Pat. No. 3,723,330—Sheflin; etc.

Liquid detergent compositions which include terpenes, such as d-limonene, or other grease-removal solvent, although not disclosed to be in the form of o/w microemulsions, are the subject matter of the following representative patent documents: European Patent Application 0080749; British Patent Specification 1,603,047; and U.S. Pat. Nos. 4,414,128 and 4,540,505. For example, U.S. Pat. No. 4,414,128 broadly discloses an aqueous liquid detergent composition characterized by, by weight:

(a) from 1% to 20% of a synthetic anionic, nonionic, amphoteric or zwitterionic surfactant or mixture thereof;

(b) from 0.5% to 10% of a mono- or sesquiterpene or mixture thereof, at a weight ratio of (a):(b) being in the range of 5:1 to 1:3; and (c) from 0.5% 10% of a polar solvent having a solubility in water at 15° C. in the range of from 0.2% to 10%. Other ingredients present in the formulations disclosed in this patent include from 0.05% to 2% by weight of an alkali metal, ammonium or alkanolammonium soap of a $C_{13}$–$C_{24}$ fatty acid; a calcium sequestrant from 0.5% to 13% by weight; non-aqueous solvent, e.g., alcohols and glycol ethers, up to 10% by weight; and hydrotropes, e.g., urea, ethanolamines, salts of lower alkylaryl sulfonates, up to 10% by weight. All of the formulations shown in the Examples of this patent include relatively large amounts of detergent builder salts which are detrimental to surface shine.

U.S. Pat. 6,037,319 teaches a water soluble sachet containing a cleaning composition containing an alcohol and hexylene glycol.

U.S. Pat. 5,783,541 teaches a dishwashing composition disposed in a water soluble film, wherein the water soluble film is coated with a water dissolvable glue.

SUMMARY OF THE INVENTION

The present invention provides a cleaning system comprising a water soluble sachet containing a concentrate of a liquid cleaning composition having excellent foam collapse properties and excellent grease cutting property which, when diluted in a bucket, is suitable for cleaning hard surfaces such as plastic, vitreous and metal surfaces having a shiny finish, oil stained floors, automotive engines and other engines. More particularly, the improved cleaning compositions, with excellent foam collapse properties and excellent grease cutting property exhibit good grease soil removal properties due to the improved interfacial tensions, when used diluted and leave the cleaned surfaces shiny without the need of or requiring only minimal additional rinsing or wiping. The latter characteristic is evidenced by little or no visible residues on the unrinsed cleaned surfaces and, accordingly, overcomes one of the disadvantages of prior art products.

Surprisingly, these desirable results are accomplished even in the absence of polyphosphate or other inorganic or organic detergent builder salts and also in the complete absence or substantially complete absence of grease-removal solvent.

In one aspect, the invention generally provides a stable, water soluble sachet made of a water soluble thermoplastic wherein the sachet contains a liquid cleaning composition which comprises approximately by weight:

2% to 20% of triethanol amine;

10% to 35% of glycerine or a glycol selected from the group consisting of ethylene glycol, diethylene glycol and triethylene glycol and mixtures thereof;

1% to 13%, more preferably 1.5% to 12% of a fatty acid;

10% to 65%, more preferably 15% to 60% of a nonionic surfactant selected from the group consisting of an ethoxylated/propoxylated nonionic surfactant and an ethoxylated nonionic surfactant and mixtures thereof;

0 to 40%, more preferably 1% to 36% to a short chain amphiphile;

10% to 40%, more preferably 12% to 35% of an anionic surfactant;

1% to 10%, more preferably 2% to 9% of a perfume, wherein the composition does not contain hexylene glycol, a short chain amphiphile, an amine oxide surfactant, 2-butyl ethanol, isopropyl alcohol, or propylene glycol, and 0 to 5% of water.

DETAILED DESCRIPTION OF THE INVENTION

The present invention relates to a water soluble sachet containing a unit dose of a liquid cleaning composition wherein the water soluble sachet is formed from a single layer of film water soluble thermo plastic such as a polyvinyl alcohol, wherein the inner layer of the film is in contact with the liquid cleaning composition and the external layer of the film does not have a water soluble glue disposed thereon.

The liquid cleaning composition contained in the water soluble sachet comprises approximately by weight:

(a) 1% to 13%, more preferably 1.5% to 12% of a fatty acid;

(b) 2% to 20% triethanol amine;

(c) 10% to 35% of glycerine or of a glycol selected from the group consisting of ethylene glycol, diethylene glycol and triethylene glycol and mixtures thereof;

(d) 1% to 10%, more preferably 2% to 9% of a perfume;

(e) 10% to 65%, more preferably 15% to 60% of an ethoxylated/propoxylated nonionic surfactant and an ethoxylated nonionic surfactant and mixtures thereof;

(f) 0 to 40%, more preferably 1% to 36% of a short chain amphiphile; and (g) 10% to 40%, more preferably 12% to 35% of an anionic surfactant, wherein the composition does not contain hexylene glycol or an amine oxide surfactant.

As used herein and in the appended claims the term "perfume" is used in its ordinary sense to refer to and include any non-water soluble fragrant substance or mixture of substances including natural (i.e., obtained by extraction of flower, herb, blossom or plant), artificial (i.e., mixture of natural oils or oil constituents) and synthetically produced substance) odoriferous substances. Typically, perfumes are complex mixtures of blends of various organic compounds such as alcohols, aldehydes, ethers, aromatic compounds and varying amounts of essential oils (e.g., terpenes) such as from 0% to 80%, usually from 10% to 70% by weight, the essential oils themselves being volatile odoriferous compounds and also serving to dissolve the other components of the perfume.

In the present invention the precise composition of the perfume is of no particular consequence to cleaning performance so long as it meets the criteria of water immiscibility and having a pleasing odor. Naturally, of course, especially for cleaning compositions intended for use in the home, the perfume, as well as all other ingredients, should be cosmetically acceptable, i.e., non-toxic, hypoallergenic, etc.

The at least one nonionic surfactant used in the instant cleaning composition is selected from the group of an aliphatic ethoxylated nonionic surfactant and an aliphatic ethoxylated/propoxylated nonionic surfactant and mixtures thereof.

The water soluble aliphatic ethoxylated nonionic surfactants utilized in this invention are commercially well known and include the primary aliphatic alcohol ethoxylates and secondary aliphatic alcohol ethoxylates. The length of the polyethenoxy chain can be adjusted to achieve the desired balance between the hydrophobic and hydrophilic elements.

The nonionic surfactant class includes the condensation products of a higher alcohol (e.g., an alkanol containing about 8 to 16 carbon atoms in a straight or branched chain configuration) condensed with about 4 to 20 moles of ethylene oxide, for example, lauryl or myristyl alcohol condensed with about 16 moles of ethylene oxide (EO), tridecanol condensed with about 6 to 15 moles of EO, myristyl alcohol condensed with about 10 moles of EO per mole of myristyl alcohol, the condensation product of EO with a cut of coconut fatty alcohol containing a mixture of fatty alcohols with alkyl chains varying from 10 to about 14 carbon atoms in length and wherein the condensate contains either about 6 moles of EO per mole of total alcohol or about 9 moles of EO per mole of alcohol and tallow alcohol ethoxylates containing 6 EO to 11 EO per mole of alcohol.

A preferred group of the foregoing nonionic surfactants are the Neodol ethoxylates (Shell Co.), which are higher aliphatic, primary alcohol containing about 9–15 carbon atoms, such as $C_9$–$C_{11}$ alkanol condensed with 1 to 10 moles of ethylene oxide (Neodol 91-2.5, Neodol 91-5, or Neodol 91-8), $C_{12-13}$ alkanol condensed ethylene oxide (Neodol 23-6.5), $C_{12-15}$ alkanol condensed with 12 moles ethylene oxide (Neodol 25-12), $C_{14-15}$ alkanol condensed with 13 moles ethylene oxide (Neodol 45-13), and the like. Such ethoxamers have an HLB (hydrophobic lipophilic balance) value of about 8 to 15 and give good O/W emulsification, whereas ethoxamers with HLB values below 7 contain less than 4 ethyleneoxide groups and tend to be poor emulsifiers and poor detergents.

Additional satisfactory water soluble alcohol ethylene oxide condensates are the condensation products of a secondary aliphatic alcohol containing 8 to 18 carbon atoms in a straight or branched chain configuration condensed with 5 to 30 moles of ethylene oxide. Examples of commercially available nonionic detergents of the foregoing type are $C_{11}$–$C_{15}$ secondary alkanol condensed with either 9 EO (Tergitol 15-S-9) or 12 EO (Tergitol 15-S-12) marketed by Union Carbide.

One of the water soluble nonionic surfactants which can be utilized in this invention are an aliphatic ethoxylated/propoxylated nonionic surfactants which are depicted by the formula:

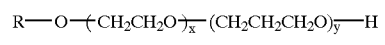

or

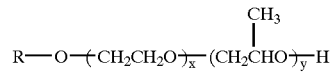

wherein R is a branched chain alkyl group having about 10 to about 16 carbon atoms, preferably an isotridecyl group and x and y are independently numbered from 1 to 20. Preferred ethoxylated/propoxylated nonionic surfactant are Plurafac® LF 300, LF 303 and LF305 manufactured by BASF. Plurafac LF300 is a more preferred material.

Suitable water-soluble non-soap, anionic surfactants used in the instant compositions include those surface-active or detergent compounds which contain an organic hydrophobic group containing generally 8 to 26 carbon atoms and preferably 10 to 18 carbon atoms in their molecular structure and at least one water-solubilizing group selected from the group of sulfonic, and carboxylic. These anionic surfactants are used in the instant composition in their acid form so as to be dispersible in the non-aqueous liquid detergent composition. Such anionic surfactants, combined in the instant composition with other active ingredients, when disperse in water will form water soluble detergents.

The instant cleaning composition contains a fatty acid. As example of the fatty acids which can be used as such or in the form of soap, mention can be made of distilled coconut oil fatty acids, "mixed vegetable" type fatty acids (e.g. high percent of saturated, mono-and/or polyunsaturated $C_{18}$ chains); oleic acid, stearic acid, palmitic acid, eiocosanoic acid, and the like, generally those fatty acids having from 8 to 22 carbon atoms being acceptable.

The liquid cleaning composition of this invention may, if desired, also contain other components either to provide additional effect or to make the product more attractive to the consumer. The following are mentioned by way of example: Colors or dyes in amounts up to 0.5% by weight; bactericides in amounts up to 1% by weight; preservatives or antioxidizing agents, such as formalin, 5-bromo-5-nitrodioxan-1,3; 5-chloro-2-methyl4-isothaliazolin-3-one, 2,6-di-tert.butyl-p-cresol, etc., in amounts up to 2% by weight.

In final form, the cleaning compositions which contain less than 5 wt. % of water exhibit stability at reduced and increased temperatures. More specifically, such compositions remain clear and stable in the range of 4° C. to 50° C., especially 2° C. to 43° C. Such compositions exhibit a pH, at 1% solution, in the acid or neutral range depending on intended end use. The liquids are readily pourable and exhibit a viscosity in the range of 6 to 60 milliPascal second (mPas.) as measured at 25° C. with a Brookfield RVT Viscometer using a #1 spindle rotating at 20 RPM. Preferably, the viscosity is maintained in the range of 10 to 50 mPas.

The compositions are easily prepared simply by combining all the ingredients in a suitable vessel or container. The order of mixing the ingredients is not particularly important and generally the various ingredients can be added sequentially.

The water soluble container which can be in the form of a sachet, a blow molded capsule or other blow molded shapes, an injected molded ampoule or other injection molded shapes, or rotationally molded spheres or capsules are formed from a water soluble thermoplastic resin. Water soluble plastics which may be considered for forming the container include low molecular weight and/or chemically modified polylactides; such polymers have been produced by Chronopol, Inc. and sold under the Heplon trademark. Also included in the water soluble polymer family are melt processable poly(vinyl) alcohol resins (PVA); such resins are produced by Texas Polymer Services, Inc., tradenamed Vinex, and are produced under license from Air Products and Chemicals, Inc. and Monosol film produced by Chris Craft Film. Other suitable resins include poly (ethylene oxide) and cellulose derived water soluble carbohydrates. The former are produced by Union Carbide, Inc. and sold under the tradename Polyox; the latter are produced by Dow Chemical, Inc. and sold under the Methocel trademark. Typically, the cellulose derived water soluble polymers are not readily melt processable. The preferred water soluble thermoplastic resin for this application is Chris Craft Film. Any number or combination of PVA resins can be used. The preferred grade, considering resin processability, container durability, water solubility characteristics, and commercial viability is Monosol film having a weight average molecular weight range of about 55,000 to 65,000 and a number average molecular weight range of about 27,000 to 33,000.

The sachet may be formed from poly(vinyl) alcohol film. The pelletized, pre-dried, melt processable polyvinyl alcohol (PVA) resin, is feed to a film extruder. The feed material may also contain pre-dried color concentrate which uses a PVA carrier resin. Other additives, similarly prepared, such as antioxidants, UV stabilizers, anti-blocking additives, etc. may also be added to the extruder. The resin and concentrate are melt blended in the extruder. The extruder die may consist of a circular die for producing blown film or a coat hanger die for producing cast film. Circular dies may have rotating die lips and/or mandrels to modify visual appearance and/or properties.

Typical film properties are:

1. Tensile strength (125 mil, break, 50% RH)=4,700 to 5,700 psi
2. Tensile modulus (125 mil, 50% RH)=47,000 to 243,000 psi; preferred range is 140,000 to 150,000 psi
3. Tear resistance (mean) (ASTM-D-199 gm/ml)=900–1500
4. Impact strength (mean) (ASTM-D-1709, gm)=600–1,000
5. 100% Elongation (mean) (ASTM-D-882, psi)=300–600
6. Oygen transmission (1.5 mil, 0% RH, 1 atm)=0.0350 to 0.450 cc/100 sq. in./24 h 7. Oxygen transmission (1.5 mil, 50% RH, 1 atm)=1.20 to 1.50 cc/100 sq. in./24 h
8. 100% modulus (mean) (ASTM-D-882, psi)=1000–3000
9. Solubility (sec) (MSTM-205,75° F.) disintegration=1-15; dissolution=10–30

Typical resin properties are:

1. Glass Transition Temperature (° C.)=28 to 38; preferred is 28 to 33,
2. Weight Average Molecular Weight (Mw)=15,000 to 95,000; preferred is 55,000–65,000
3. Number Average Molecular Weight (Mn)=7,500 to 60,000; preferred is 27,000 to 33,000. Preferred poly (vinyl) alcohol film is formed from Monosol 7030 or Monosol 8630

The extruded film is slit to the appropriate width and wound on cores. Each core holds one reel of film. The reels of slit film are fed to either a vertical form, fill, seal machine (VFFS) or a horizontal form, fill, seal machine (HFFS). The Form, Fill, Seal machine (FFS) makes the appropriate sachet shape (cylinder, square, pillow, oval, etc.) from the film and seals the edges longitudinally (machine direction seal). The FFS machine also makes an end seal (transverse direction seal) and fills the appropriate volume of non-aqueous liquid above the initial transverse seal. The FFS machine then applies another end seal. The liquid is contained in the volume between the two end seals.

Blow molded capsules are formed from the poly(vinyl) alcohol resin having a molecular weight of about 50,000 to about 70,000 and a glass transition temperature of about 28 to 33° C. Pelletized resin and concentrate(s) are feed into an extruder. The extruder into which they are fed has a circular, oval, square or rectangular die and an appropriate mandrel. The molten polymer mass exits the die and assumes the shape of the die/mandrel combination. Air is blown into the interior volume of the extrudate (parison) while the extrudate contacts a pair of split molds. The molds control the final shape of the package. While in the mold, the package is filled with the appropriate volume of liquid. The mold quenches the plastic. The liquid is contained within the interior volume of the blow molded package.

An injection molded ampoule or capsule is formed from the poly(vinyl) alcohol resin having a molecular weight of about 50,000 to about 70,000 and a glass transition temperature of about 28 to 38° C. Pelletized resin and concentrate(s) are fed to the throat of an reciprocating screw, injection molding machine. The rotation of the screw pushes the pelletized mass forward while the increasing diameter of the screw compresses the pellets and forces them to contact the machine's heated barrel. The combination of heat, conducted to the pellets by the barrel and frictional heat, generated by the contact of the pellets with the rotating screw, melts the pellets as they are pushed forward. The molten polymer mass collects in front of the screw as the screw rotates and begins to retract to the rear of the machine. At the appropriate time, the screw moves forward forcing the melt through the nozzle at the tip of the machine and into a mold or hot runner system which feeds several molds. The molds control the shape of the finished package. The package may be filled with liquid either while in the mold or after ejection from the mold. The filling port of the package is heat sealed after filling is completed. This process may be conducted either in-line or off-line.

A rotationally molded sphere or capsule is formed from the poly(vinyl) alcohol resin having a molecular weight of about 50,000 to about 70,000 and a glass transition temperature of about 28 to 38° C. Pelletized resin and concentrate are pulverized to an appropriate mesh size, typically 35 mesh. A specific weight of the pulverized resin is fed to a cold mold having the desired shape and volume. The mold is sealed and heated while simultaneously rotating in three directions. The powder melts and coats the entire inside surface of the mold. While continuously rotating, the mold is cooled so that the resin solidifies into a shape which replicates the size and texture of the mold. After rejection of the finished package, the liquid is injected into the hollow package using a heated needle or probe after filling, the injection port of the package is heat sealed.

The following examples illustrate liquid cleaning compositions of the described invention. Unless otherwise specified, the proportions in the film and elsewhere in the specification are by weight.

EXAMPLE 1

The following formulas were prepared in wt. % by simple mixing:

| | 1 | 2 | 3 | 4 |
|---|---|---|---|---|
| Plurafac LF 300 | 0 | 10 | 20 | 25 |
| Neodol 91-5 | 20 | 10 | 20 | 25 |
| Linear alkyl benzene sulfonate | 35 | 35 | 25 | 15 |
| Glycerol | 25 | 25 | 17.5 | 17.5 |
| Coco fatty acid | 2 | 2 | 2 | 2 |
| Perfume | 8 | 8 | 8 | 8 |
| Triethanol amine | 10 | 10 | 7.5 | 7.5 |
| Aspect | clear | clear | clear | clear |
| Residue/shine | Better | Better | Better | Better |
| Grease cutting | Equal | Slightly worse | Equal | Slightly Better |
| Foam collapse | No collapse | No collapse | No collapse | No collapse |

| | Ref |
|---|---|
| Plurafac F300 | 1.2 |
| Paraffin Sulfonate | 1.8 |
| Neodol 91-8 | 2.4 |
| Emulan HE50 | 1.2 |
| Soap | 0.25 |
| Perfume | 0.8 |
| MgSO4 7H2O | 1 |
| pH | 6.5 |
| Aspect | Clear |

The above formulas were filed at a dosage of 7.5 g by the previously described method into a polyvinyl alcohol sachet having a film thickness of about 0.25 to 5 mls, more preferably 1 to 3 mls.

The sachets containing the above formulas were dissolved in one to two minutes in 500 ml of water in a vessel.

What is claimed:

1. A cleaning system which comprises:

(a) a water soluble container selected from the group consisting of a sachet, ampoule capsule or sphere and wherein said container is formed from a polyvinyl alcohol polymer;

(b) a liquid cleaning composition disposed in said water soluble container, wherein said liquid cleaning composition comprises approximately by weight:

(i) 1% to 13% of a fatty acid;

(ii) 10% to 65% of at least one nonionic surfactant;

(iii) 1% to 10% of a perfume;

(iv) 2% to 20% of triethanol amine;

(v) 10% to 35% of glycerine or of a glycol selected from the group consisting of ethylene glycol, diethylene glycol and triethylene glycol and mixtures thereof;

(vi) 10% to 40% of an anionic surfactant and (vii) about 2% by weight of a preservative selected from the group consisting of 5-bromo-2-methyl-4-isothaliazolin-3-one, 2,6-di-tert.butyl-p-cresol and mixtures thereof and wherein said composition does not contain a hexylene glycol, an amine oxide surfactant, 2-butyl ethanol, isopropyl alcohol or propylene glycol.

2. The system according to claim 1 wherein said nonionic surfactant is selected from the group consisting of ethoxylated nonionic surfactants and ethoxylated/propoxylated nonionic surfactants.

3. The system according to claim 1 wherein said anionic surfactant is a sulfonated surfactant.

4. The system according to claim 1 wherein said liquid cleaning composition further includes a short chain amphiphile.

5. The system according to claim 1 wherein said liquid cleaning composition further contains up to 5% water.

* * * * *